US005454869A

United States Patent [19]

Roden

[11] Patent Number: 5,454,869

[45] Date of Patent: Oct. 3, 1995

[54] SEALANT APPLICATOR/INJECTOR

[75] Inventor: William A. Roden, San Diego, Calif.

[73] Assignee: General Dynamics Corporation, San Diego, Calif.

[21] Appl. No.: 110,267

[22] Filed: Oct. 12, 1993

[51] Int. Cl.[6] ..... B05C 7/00

[52] U.S. Cl. ..... 118/254; 29/34 B; 118/300; 118/651; 239/752; 901/12; 901/22; 901/43

[58] Field of Search ..... 118/681, 300, 118/254; 239/752, 753; 901/22, 43, 12; 414/749; 29/34 B, 458, 525.2

[56] References Cited

U.S. PATENT DOCUMENTS

| | | | |
|---|---|---|---|
| 4,256,511 | 3/1981 | Atchison et al. | 239/752 |
| 4,466,572 | 8/1984 | Shelton | 239/752 |
| 4,872,417 | 10/1989 | Kuwabara et al. | 239/752 |
| 4,951,849 | 8/1990 | Townsend et al. | 901/43 |
| 5,085,374 | 2/1992 | Okuda et al. | 239/752 |
| 5,100,286 | 3/1992 | Anderson | 414/749 |
| 5,141,165 | 8/1992 | Sharpless et al. | 239/752 |
| 5,198,736 | 3/1993 | Azuma et al. | 414/749 |

*Primary Examiner*—W. Gary Jones
*Assistant Examiner*—Laura E. Edwards
*Attorney, Agent, or Firm*—John R. Duncan; Frank D. Gilliam

[57] ABSTRACT

A linear actuated sealant applicator pump for pumping a sealant into an aperture prior to installation of a fastener in that aperture. An air driven linear actuator translates a cam plate carrying a sealant applicator head from a first position in a first direction spaced from and slightly out of vertical alignment with the aperture to which sealant is to be applied. An adjustable stop limits the translation of the cam plate and injector pump. The actuator then continues in the first direction causing the cam plate to follow a cam slot translating the sealant applicator head in a second direction normal to the first direction toward and in vertical alignment with the aperture with the head engaging the edges of the aperture. The engagement of the head with the edges of the aperture prevents further translation of the sealant applicator head into the aperture. The linear actuator continues to move the cam plate along the cam slot after head and aperture edge engagement causing the cam plate to continue to follow the cam slot resulting in the sealant applicator head being forced to translate upwardly in reverse to the second direction providing a pumping action within the applicator head which pumps a pre-selected amount of sealant from the sealant applicator head into the aperture. The linear actuator when reaching a maximum first direction translation position reverses its direction.

5 Claims, 2 Drawing Sheets

SEALANT APPLICATOR/INJECTOR

BACKGROUND OF THE INVENTION

The invention is directed to an efficient means of depositing a sealant material into an aperture prior to the deposit and securing of a fastener into that aperture.

In many manufacturing operations where materials are fastened together with rivets, screws, bolts, etc. it is required that the fasteners are sealed to the material to prevent air, liquids, etc. from penetrating the fasteners and apertures.

The sealant can of course be done by hand just prior to inserting the fastener into the aperture. However, with high speed riveting machines and the like a manual application of sealant becomes impractical.

There are devices which attach to automatic machines and the like which in advance of depositing and setting a fastener in a an aperture deposit an amount of sealant into the aperture. These machines although somewhat successful for the purpose intended have no control over the volume of sealant deposited into the aperture which results in either an insufficient amount of sealant being deposited to seal the fastener to the material or an excess of sealant is applied resulting in waste and the requirement of unnecessary clean up of the end product. Further the state of the art sealant deposit devices require considerable cleanup after each operation prior to beginning a new operation.

One of the existing devices of the current state of the art is the model 91180D1.00 manufactured by ITC Aerospace Company.

There has been a long standing need for an efficient means for depositing a sealant into an aperture prior to a fastener being installed therein. The present invention will fill that long held need.

SUMMARY OF THE INVENTION

The present invention is directed to a pump injector head which deposits a controlled amount of sealant into an aperture to be sealed prior to a fastener being installed in that aperture. The pump injector of the invention is generally installed on an automatic fastener installing and securing device such as, but not limited to, an automatic riveting machine for drilling apertures, installing a rivet into that aperture and then setting that rivet therein. The pump injector head is positioned on the automatic fastener installing machine so that it can engage an aperture prior to the fastener being inserted into that aperture.

The injector head of the device comprises a feed tube which maintains a reservoir in the head with sealant material, a housing which caries the reservoir and an injector head. The injector head dispenses the sealant material from the reservoir into the aperture. The injector head is translatable relative to the feed tube and when the injector head is translated sealant material from the reservoir is forced from the injector head into the aperture. The amount of feed tube insertion into the reservoir determines the quantity of sealant material being deposited in the aperture. The feed tube is infinitely adjustable through a fixed range of insertion depths into the reservoir to insure just the needed amount of sealant is deposited in the aperture. A biasing spring returns the relative positions of the feed tube and reservoir to a home position after the sealant deposit operation has been completed.

The device operates as follows, a bi-directional linear actuator generally pneumatically actuated operates a cam block. The cam block is supported and guided during a portion of its travel by a dove tail connection to a gib block housing which supports the cam block and attached applicator head. The actuator, from a home position, translates the cam block horizontally a predetermined distance which translates the cam in the same direction as the linear actuator and then in a direction normal to first direction of travel wherein sealant is deposited from the sealant head by a novel pumping means into a selected aperture and then the linear actuator reverses it direction of travel returning the cam block to the home position during each sealant material deposit operation. When the actuator piston rod begins to extend the cam block translates along a dove tail slot in a gib block housing in a first liner horizontal direction with the actuator piston rod after traveling a predetermined distance an adjustable stop is reached and the linear horizontal direction of the cam block is terminated while the piston rod continues to travel in the same first direction. After the stop is reached the cam block translates in a direction normal to the first direction guided by a linear ball bushing and a non-flanged ball bearing. The travel distance is determined by the length of a cam slot. The movement of the cam block causes the injector head to travel downward and engage the outer surface of a fixed in place aperture. As the piston rod continues to extend the cam block continues to travel downward, however, the injector pump head cannot translate further downward as it is stopped by the edges of the fixed in place aperture, at this time the injector tip is caused to translates upward in an opposite direction to the travel of the cam block causing a high pressure pump in the injector head to pump a predetermined quantity of sealant material into the aperture. When the linear actuator piston rod reaches the end of its travel in the cam slot, the actuator reverses its direction of travel back to the opposite end of the cam slot and then back to a home position. During the return translation of the piston rod, the injector pump head translates away from the aperture in which the sealant material was just deposited and is pulled back into its home position. The process is repeated for each aperture to be sealed. The piston rod is moved between the home and extended positions by a conventional fluid powered reversible hydraulic cylinder.

An object of this invention is to provide an adjustable pump type sealant material injector which develops high pressure with fast response.

Another object of the invention is to provide a high pressure sealant injector system which requires a minimum of cleanup after use.

Still another object of this invention is to provide a high pressure sealant injector pump which uses inexpensive throw away tip and plunger.

Yet another object of this invention is to provide a high pressure injector pump which can be precisely adjusted to deposit a predetermined amount of sealant material into an aperture during each sealant operation time after time.

Yet another object of this invention is to provide a high pressure injection pump which operates to deposit sealant in apertures at high speed.

Other objects and features of the invention will become apparent as the drawings which follow are understood by reading the corresponding description thereof.

BRIEF DESCRIPTION OF THE DRAWING FIGURES

DETAILED DESCRIPTION OF THE PREFERRED EMBODIMENT

Figure 1:
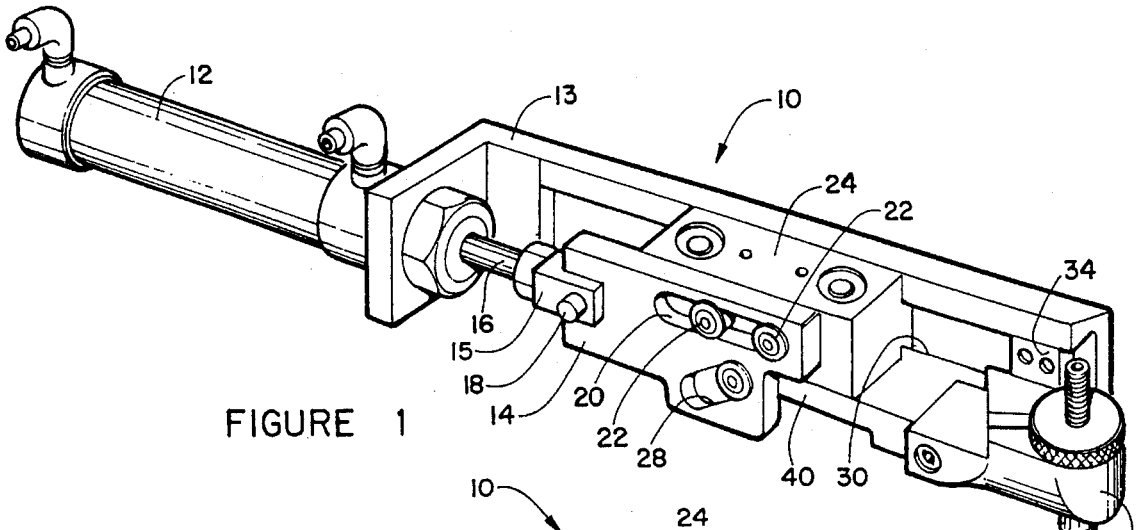
FIG. 1 depicts a perspective showing of the mechanism of the high pressure injector pump of the invention in a home position.

Referring now the drawing Figures and specifically to drawing FIGS. 1–4, in which a perspective and three side views of the high pressure sealant injector pump 10 is shown. The pump 10 includes a bi-directional linear actuator 12 which is supported by way base or support bracket 13. While actuator 12 may be powered by any suitable fluid, it is preferably air powered by air under pressure from any conventional source such as schematically indicated air supply 17. The actuator includes a piston rod 16 pivotly attached to a cam plate 14. Actuator 12 is a conventional reversible fluid powered hydraulic cylinder. The connection of the piston rod to the cam plate is through a clevis 15 fixedly attached to the piston rod 16 of the linear actuator 12. The clevis is pivotly attached to the cam plate by a pin 18. The cam plate includes an elongated channel 20 which acts as a guide channel for linear translation of the cam plate. Outer flanged roller bearings 22 carried by a dovetail gib block 24 ride within the elongated channel 20 with the flanged outer surface 26 of the roller bearing maintaining the cam plate and gib plate attachment. An additional roller bearing 25 without a flange is carried by the way base 13 provides additional low friction guidance and support for the cam plated during both the first horizontal direction translation and the second direction of translation normal to the horizontal translation relative to the way base.

The cam plate additionally includes a second angled elongated channel 28. A flanged bearing 22 also attached to the gib plate rides within the elongated channel 28 and provides low friction guidance of relative translation between the flanged bearing 22 and the engaging surfaces of the elongated channel. The purpose of the two elongated channels 20 and 28 will be explained herein after in greater detail.

The gib block 24 includes a dovetail connection 30 to the support bracket 13 which supports the linear actuator, the gib block, cam plate and sealant depositing head 32 which includes the high pressure injection pump hereinafter explained in more detail. The dovetail connection between the support bracket and gib plate allows translation of the gib plate relative to the support bracket and the cam slots 20 and 28 allow relative translation between the support bracket, gib plate and cam block.

The support bracket 13 is attached to the fastener applying head of a riveting machine, robot or the like (not shown) which positions the sealing injector pump 10 either manually or by numerical control in position for adhesive deposit operation.

An adjustable stop 34 is attached via set screws or the like to the dovetail way and is positionable along the dovetail way to adjust the limitation of the horizontal first direction of translation of the gib block 24 by the translation of piston rod 16.

Figure 2:
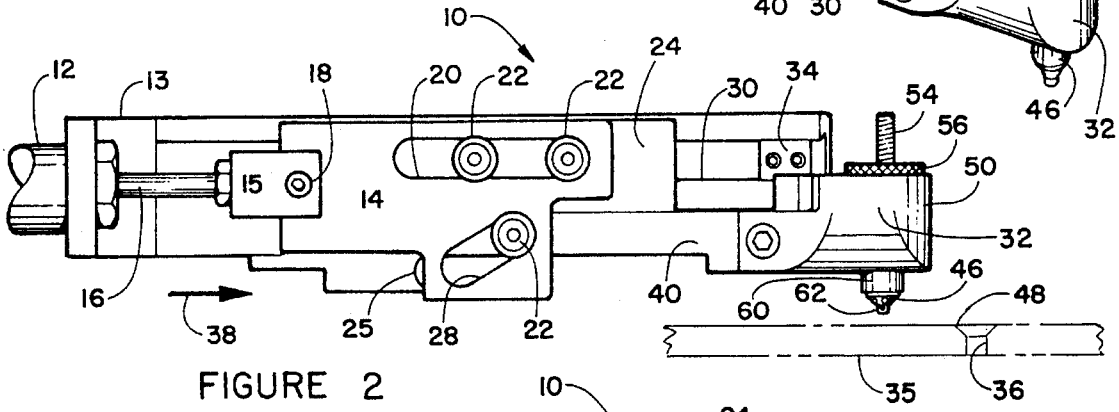
FIG. 2 depicts a side view of FIG. 1.
Figure 3:
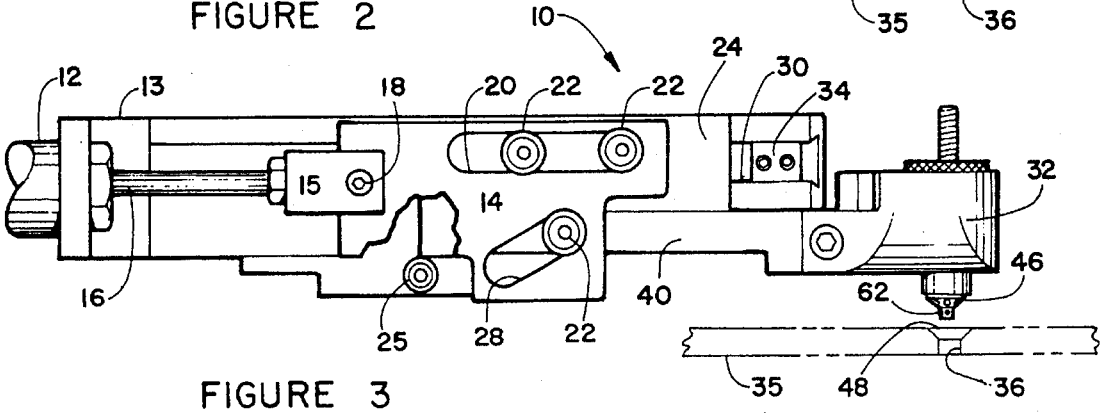
FIG. 3 depicts translating mechanism of the high pressure injector pump of the invention in an intermediate position.

In operation, the injector pump 10 is positioned as shown in drawing FIG. 2 adjacent to fixed in place structure 35 and slightly out of vertical alignment to an aperture 36 into which sealant is to be deposited. The piston rod 16 of the actuator 12 is caused to move along arrow 38 moving the head 32 into nearly vertical alignment with the aperture 36 (see drawing FIG. 3). The horizontal first directional movement of gib block 24 and cam plate 14 is terminated when the gib block engages now fixed in place adjustable stop 34. When the horizontal translation of the gib block is terminated, the piston rod continues to extend in the first direction along arrow 38, portion 40 of the support 13 is caused to translate slightly in the same direction vertically aligning the injector head with the aperture 36. The portion 40 then travels in a second direction which is normal to the direction along arrow 38 in the direction of arrow 42 shown in drawing FIG. 4 guided by shaft 44 and roller bearing 25.

Figure 4:
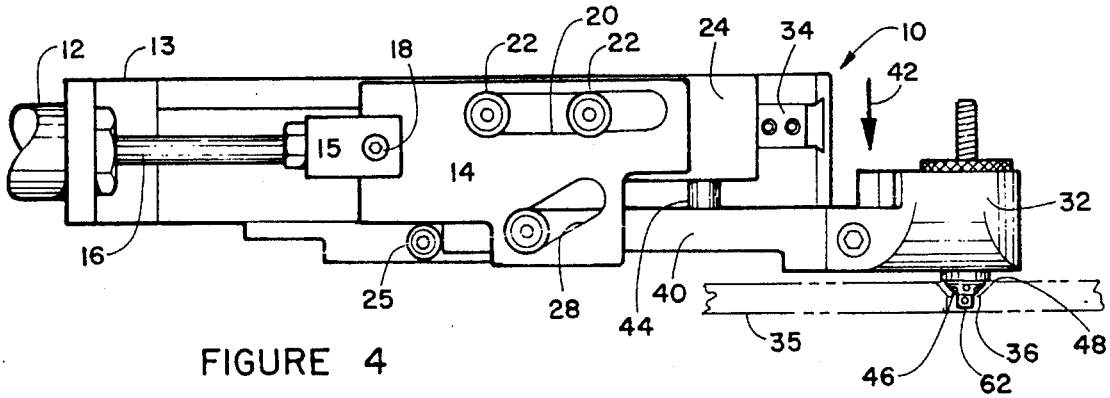
FIG. 4 depicts translating mechanism of the high pressure injector pump of the invention with the sealant deposition head in an maximum extended position.
Figure 5:
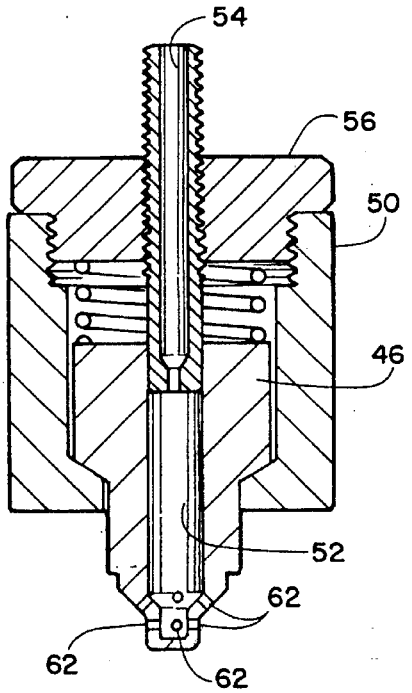
FIG. 5 depicts cross-section through the high pressure injector head showing the details of the head.
Figure 6:
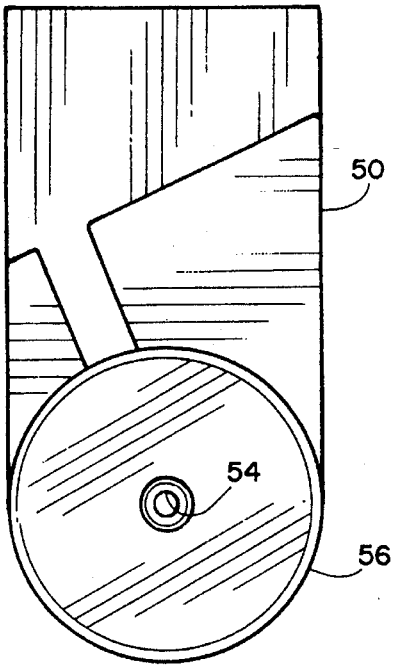
FIG. 6 is a top plan view of the high pressure injector head of FIG. 5.

Referring now specifically to drawing FIGS. 4–6, the translation of the head 32 in the direction of arrow 42 causes the head sealant injector tip 46 to engage the lip 48 of aperture 36 terminating the downward translation of the head 32. As the portion 40 continues in this direction of travel, the injector tip 46 is caused to translate in the opposite direction pumping a selected amount of sealant into the aperture 36.

A cross-section of the injector pump is shown in drawing FIG. 5. The pump comprises an external housing 50; a sealant cavity 52 for containing sealant; the sealant is delivered through feed tube 54 from a storage container (not shown) to cavity 52; The fed tube threadedly engages a cap 56; the cap 56 is threadedly attached to and vertically adjustable relative to the housing 50; and a biasing spring 58 bias the cap 56 relative to the translating injector tip 46, the injector tip 46 translates relative to the feed tube 54.

In operation, the cap 56 is adjusted so that the translation of the injector tip 46 is controlled by the tension on the biasing spring 58 which increases with the adjustment of the cap toward and away from the cavity. The cavity 52 is normally filed with the sealant to be deposited. When the portion 40 translates the sealant head to a position against the aperture and continues to translate downward the injector tip 46 is caused to translate upward toward the cap 56 causing the sealant in the cavity to be displaced through the apertures 62 in the tip 46 into the aperture 36 depositing a predetermined amount of the sealant into the aperture. When the sealant is deposited the piston rod 16 is caused to reverse direction as hereinbefore discussed against translating the injector tip 46 to the drawing FIG. 4 position at which time the cavity is refiled with sealant from the storage container.

The device can be constructed from any material suitable for the purpose intended.

While specific embodiments of the sealant applicator/injector has been shown and fully explained above for the purpose of illustration it should be understood that many alterations, modifications and substitutions may be made to the instant invention disclosure without departing from the spirit and scope of the invention as defined by the appended claims.

What is claimed is:

1. An apparatus for depositing sealant within an aperture having an outer edge in which a connector is to be sealed comprising:

a sealant applicator;

a means for translating said applicator from a rest position in a first direction a pre-selected distance and then in a second direction of translation normal to said first direction of translation a fixed distance;

a fixed length cam slot disposed on said applicator for determining said fixed distance of travel of said applicator in said second direction;

an application head on said applicator, said application head carrying a tip through which sealant can be applyed; and a high pressure pump within said application head, wherein a selected quantity of sealant is deposited into said aperture when said tip engages said outer edge of said aperture during a final portion of said second direction of travel said pump is operated to deposit a selected quantity of sealant into said aperture.

2. The invention as defined in claim 1 wherein said means for translating is a linear actuator.

3. The invention as defined in claim 1 further including an adjustable stop disposed on said applicator for determining said selected distance of travel of said applicator in said first direction.

4. The invention as defined in claim 1 wherein said applicator in its first direction of translation is supported by roller bearings.

5. The invention as defined in claim 1 wherein said applicator in its second direction of travel is guided by a shaft.

* * * * *